United States Patent [19]

Coles

[11] 4,384,437

[45] May 24, 1983

[54] HEAT INSULATING ROOFING SYSTEMS

[75] Inventor: Frederick C. Coles, Upper Holton, England

[73] Assignee: Anglia Jay Purlin Company Limited, Suffolk, England

[21] Appl. No.: 201,585

[22] Filed: Oct. 28, 1980

[51] Int. Cl.[3] ..... E04B 1/74

[52] U.S. Cl. ..... 52/404; 52/484

[58] Field of Search ..... 52/404, 484, 730, 732, 52/728, 727, 720

[56] References Cited

U.S. PATENT DOCUMENTS

| | | | |
|---|---|---|---|
| 3,748,998 | 7/1973 | Lambert | 52/732 X |
| 3,988,871 | 11/1976 | Moomey | 52/484 |
| 4,233,791 | 11/1980 | Kuhl et al. | 52/404 |
| 4,251,972 | 2/1981 | Interlante | 52/404 |

FOREIGN PATENT DOCUMENTS

| | | | |
|---|---|---|---|
| 784319 | 10/1957 | United Kingdom | 52/404 |

*Primary Examiner*—J. Karl Bell

*Attorney, Agent, or Firm*—Lee, Smith & Jager

[57] ABSTRACT

A heat insulating roof structure for an industrial building, in the form of an inter-purlin system comprising spaced parallel purlins (10, 10A or 35, 35A or 45, 45A) having their base webs (14 or 41 or 50, 51) sheathed by a heat insulating sleeve (16, 17 or 53, 54 or 56, 57), thereby to provide lateral platforms on opposite sides of the purlin for the support of cross members (29 or 70) which form trays to support a layer of heat insulating material (31). In one form of embodiment the cross members are inverted tee bars (29), thereby forming open rectangularly framed trays for supporting the insulating layer. In another form of embodiment the cross members are closed tray bases (70) especially suitable for a vapor sealed system. In all embodiments the insulating sleeve assembly (16, 17 or 53, 54 or 56, 57) serve to minimize or avoid the creation of a cold bridge between the warm building interior and the cold space above the insulating layer (31).

16 Claims, 14 Drawing Figures

10
10A
11
12
13
14
15
16
16A
17
18
19
23
24
29
30
31

HEAT INSULATING ROOFING SYSTEMS

FIELD OF THE INVENTION

This invention relates to an insulating roofing system, more especially an insulating roofing system for industrial buildings.

BACKGROUND TO THE DISCLOSURE

In roofing structures for industrial buildings, the outer skin is usually formed by roofing sheets, e.g. asbestos sheets, which are clamped by means of hook members to the turned back edges of the upper lateral flanges of the purlins. Conventionally, the purlins have a Z-shaped cross-section and are known as Z-purlins. At the present time, there invariably exists a requirement to incorporate insulation in the roof structure.

PRIOR ART

Accordingly, it has been the usual practice to employ an over-purlin insulating system, wherein the insulation is fixed under the outer roofing sheets, supported by suitable inner roofing sheets, the respective layers all being clamped in position over the tops of the purlins by means of long-stemmed hook members.

As higher standards of insulation are demanded, possibly to a U-value as low as 0.6 or even 0.4, it is also necessary to employ spacers to create an air gap between the insulating layer and the outer skin of the roof, and additionally to provide an insulating layer of increased thickness, requiring the use of hook members of further increased stem length.

This gives rise to various disadvantages, however, especially in placing additional strain on the hook-shaped members and on the top flanges of the purlins, thereby giving increased risk of substantial deformation, and in creating a cold space between the insulation and the outer skin which is not readily ventilated, so that severe condensation problems can arise due to the escape of warm moist air from the main interior of the building upwardly into said cold space.

Alternatively, under-purlin systems are known, involving the suspension of a framework of longitudinal and lateral tee-bars beneath the base webs of the purlins, said framework carrying the required heat insulating layer. These systems are complex, complicated to erect, and are therefore expensive.

OBJECT OF THE INVENTION

It is an object of this invention to provide a heat insulating roofing system which minimises or avoids the disadvantages of known over-purlin insulating systems, without introducing the complexity, expense and differing disadvantages which arise with alternative under-purlin insulating systems.

BRIEF SUMMARY OF THE INVENTION

According to one aspect of the present invention, there is provided an interpurlin heat insulating roofing structure comprising a plurality of spaced parallel roof purlins each having at least one lateral base web, a heat insulating sleeve sheathing the base web or webs of each purlin, and cross members supported between the purlins on the sheathed base webs thereof, said cross members comprising or carrying a layer of heat insulating material.

The insulating sleeve preferably comprises the assembly of a rigid outer sleeve with a heat insulating filler recessed or slotted to accommodate the base web or webs of the purlin.

Thus, according to another aspect of the present invention, there is provided, for incorporation in a heat insulating roof structure of the above-defined form, a heat insulating sleeve assembly adapted to sheath the base web or webs of each purlin, said sleeve assembly comprising an outer relatively rigid sleeve of metal or fire-retardant plastics material, said sleeve being of U-shape with inturned flanges at the upper ends of its limbs, and an infilling of less rigid heat insulating material which is recessed or slotted to accommodate the web or webs of the purlin. The insulating sleeve assembly can readily be constructed with both good heat insulating and good fire-retarding properties. Thus, the outer sleeve may be of metal or of fire-resistant platics material such as P.V.C., protecting the heat insulating infilling which may be a formed plastics such as expanded polystyrene or polyurethane.

FURTHER FEATURES OF THE INVENTION

In one form of embodiment of the present invention, said cross members supported between the purlins comprise crosspieces, such as inverted tee-bars, which form rectangularly framed trays each defined by two opposed insulating sleeves and two opposed crosspieces. Said trays may receive rigid heat insulating boards cut to size, or inner roofing sheets on which a loose heat insulating material is laid. Clips are preferably provided to hold the heat insulating layer down in the trays and prevent possible "lift" thereof.

In another form of embodiment of the invention, said cross members supported between the purlins comprise a plurality of tray bases. This structure is especially adapted to the production of a vapour sealed roof system. Thus, each tray base may have opposed side walls transverse to the purlins, said side walls being adapted for interlocking engagement through a sealant to provide a vapour seal at the adjacent side edges of adjacent trays, and a strip sealant may be sandwiched between the insulating sleeves and the end edge portions of the tray bases. Strip sealants can also be employed to enable production of a vapour sealed roof system using cross members in the form of inverted tee-bars.

The importance of the insulating sleeve assembly, in all forms of embodiment, should be emphasised. This sleeve assembly substantially minimises or avoids any cold bridge between the warm and possibly moist building interior and the cold space above the insulating layer. Thus, the undersides of the purlins are covered by the sleeves to prevent upward heat conduction through the purlins from the bases thereof, and the cross members are insulated from the purlins to prevent heat transfer from these members to the purlins. The roof structure in accordance with the invention also facilitates ventilation of the cold space above the insulating layer, for example by means of louvred barge boards at the eaves of the building, so that problems of condensation, especially in a non-vapour sealed system, are minimised. It is also apparent that it is possible to revert to the use of standard length hook members for securing the outer roofing sheets in position, thus reducing the possibility of deformation occurring within the roof structure.

In practice of the invention, conventional Z-purlins are preferably employed, but this is not essential, and other kinds of purlin having a bottom flange to one side, such as a so-called multibeam purlin having a fold in its main web, or purlins having two oppositely directed base webs, such as an inverted J-purlin, may be employed instead. In the case of a purlin having a base web to one side only, the insulating sleeve is employed to provide a lateral platform on the side of the purlin opposite said web.

In a preferred arrangement, the insulating sleeve assembly is of a wide U-shape, the outer sleeve having an inturned flange along the free edge of at least one of its limbs. This inturned flange, with a downwardly angled lip along its outer edge, can be hooked over the upturned edge portion of the bottom flange of a conventional Z-purlin, temporarily to provide sole support for the outer sleeve and the insulating filler within it, until the filled sleeve is pivoted up against the purlin bottom flange and the other limb of the outer sleeve is fixed in position. This other limb of the outer sleeve is preferably mounted to the main web of the purlin by means of a retaining clip having a U-portion to embrace said other limb and an upstanding flange secured, preferably by means of a nut and bolt, to the purlin main web.

The outer sleeve of the insulating sleeve assembly preferably has inturned flanges along the upper edges of both its limbs, at the same level in relation to the purlin, and it is these inturned flanges which provide direct support for the insulating layer.

Thus, in the preferred arrangement, inverted tee-bars are laid in parallel relationship between adjacent purlins, thereby to form open rectangular trays for receiving inner roofing or ceiling sheets. As previously indicated, these sheets may be thick rigid sheets of insulating material, or thin rigid sheets such as plasterboard on which flexible or loose insulating material is laid.

Although not essential, it is preferred for the inverted tee-bars to seat in locating slots pressed out from the inturned flanges of the outer sleeve of the insulating sleeve assembly, retaining clips being located over said inverted tee-bars and under the ends of the inturned flanges adjoining the slots in order to secure the inverted tee-bars in position.

Alternatively, again as previously indicated, it is possible to lay separately fabricated metal trays between the purlins to support the insulating layer.

In another embodiment of the invention, purlins each having two opposed base webs, for example an inverted J-purlin, are employed. Since this kind of purlin is unconventional, it should be explained that a J-purlin is a purlin having a main web extending between transverse webs perpendicular to the main web at the respective opposite longitudinal edges of the latter, wherein at one longitudinal edge a single transverse web projects laterally only to one side of the main web and has a longitudinal outer edge portion turned back parallel to the main web, while at the other longitudinal edge of the main web transverse webs project laterally respectively to opposite sides of the main web. In practice, a steel J-purlin may be produced by cold rolling, the oppositely directed webs, which may be referred to as base webs, being formed by folding a steel sheet back beneath itself to form one transverse web having a double thickness of metal, the sheet then extending continuously past the bottom of the main web to form the other transverse web, which has a single thickness of metal. Preferably, to strengthen the latter transverse web, its free longitudinal edge is rolled over to form a stiffening lip.

An inverted J-purlin can have greater resistance to twisting than the conventional Z-purlin, especially by incorporating one or more bends or folds in the main web, as is the case with the J-purlin used in the alternative embodiment of roof structure of this invention.

In the case of a roof structure using J-purlins, the insulating sleeve comprises one or more recessed or slotted elongate members of heat insulating material which are assembled, for example with the aid of relatively rigid outer sleeving and retaining bands, to encase the oppositely facing base webs at the bottom of each purlin, thereby both covering the undersurface of said base webs with a lower insulating layer and providing an upper insulating layer above at least part of each such base web, the upper surface of said upper insulating layer providing a support for the inverted tee-bars or other cross members.

In other respects, the roof structure based on J-purlins is generally similar to that based on Z-purlins.

When multibeam purlins are employed in the roof structure of this invention, an insulating sleeve assembly similar to that used for Z-purlins is employed.

BRIEF DESCRIPTION OF DRAWINGS

The heat insulating roof structure of this invention will now be described by way of example with reference to the accompanying drawings, in which.

DESCRIPTION OF EMBODIMENTS

Figure 1:
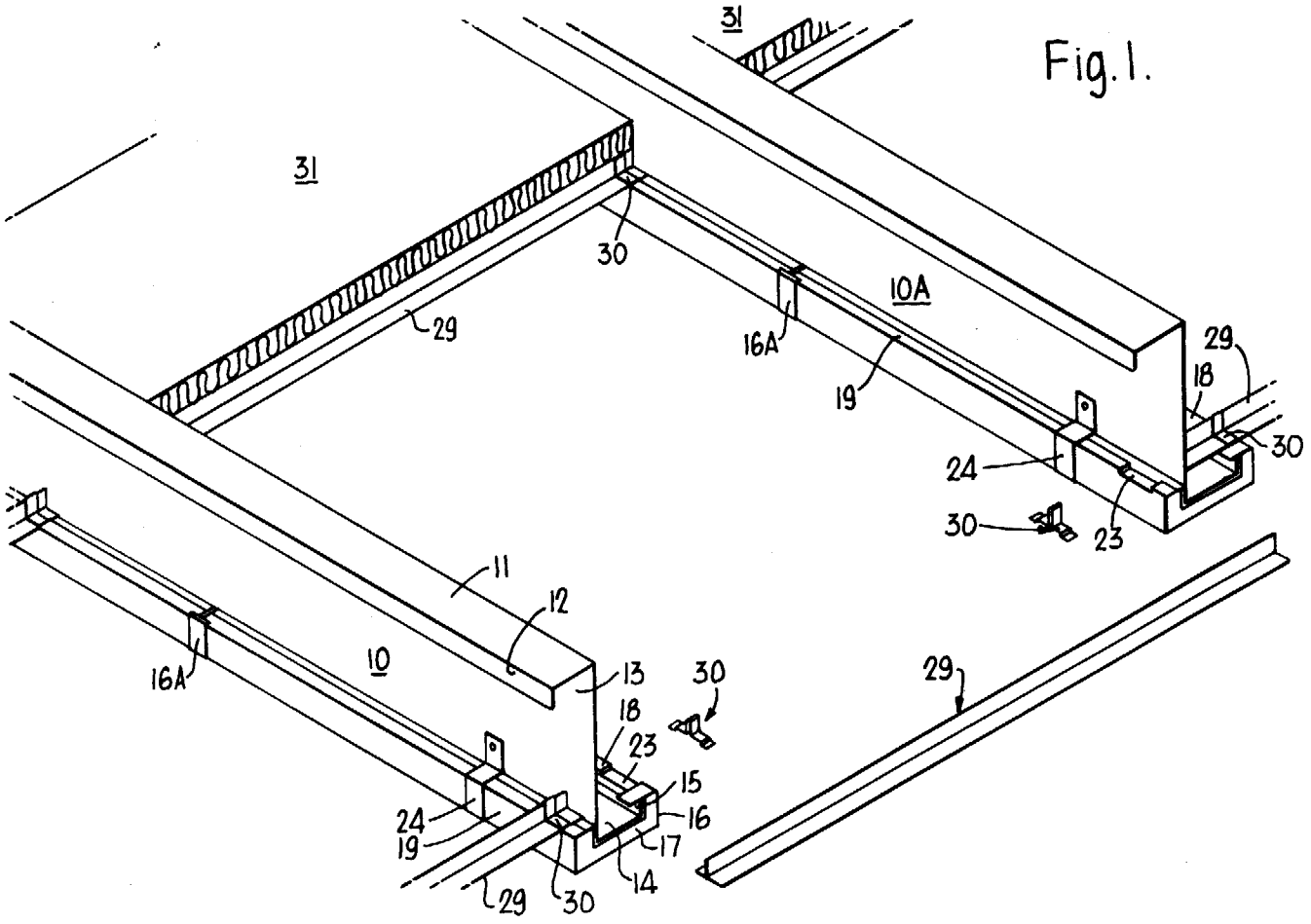
FIG. 1 is a diagrammatic perspective view of part of a preferred roof structure incorporating Z-purlins.
Figure 4:
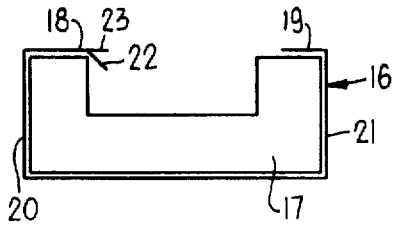
FIG. 4 is an end view of an insulating sleeve assembly suitable for a Z-purlin or multibeam purlin.
Figure 7:
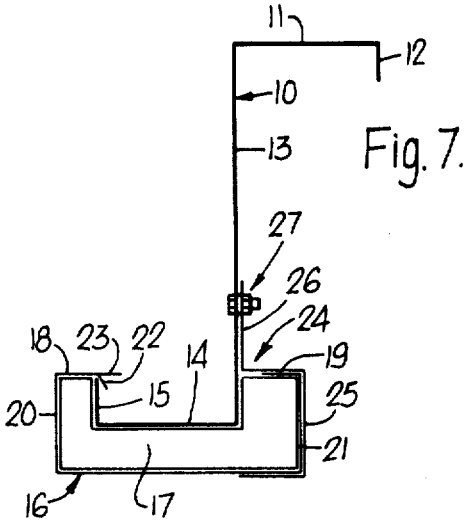
FIG. 7 shows the sleeve assembly of FIG. 4 assembled to a Z-purlin.

Referring to FIGS. 1, 4 and 7, the references 10, 10A denote two of a number of spaced parallel purlins conventionally mounted on the trusses or stanchions (not shown) in order to carry a roof structure for an industrial building. The roof is assumed to be a pitched roof, so that the purlin 10A is at a lower level than the purlin 10.

The purlins 10, 10A are conventional Z-purlins, each with a top flange 11 having a turned down lip 12 projecting to one side of the main web 13 and a bottom flange 14 with an upturned lip 15 projecting to the other side of the main web. It is to be noted that the bottom flanges 14 project away from the ridge and towards the eaves.

Mounted to the base of each purlin 10, as also shown in FIG. 7, is an insulating sleeve assembly consisting of an outer sleeve 16 of cold rolled steel, or of a relatively rigid fire retardant plastics such as P.V.C., containing an insulating filler 17, e.g. of polystyrene blocks or polyisocyanurate extruded in situ within the sleeve. FIG. 4 shows the assembly of the outer sleeve 16 and its infilling 17 separately. In practice, the outer sleeve 16 may be filled by a composite insulating block 17 made up of three sub-blocks, two filling the sides of the sleeve and one lining the centre of the sleeve between the two side sub-blocks.

Referring specifically to FIG. 4, the sleeve assembly 16, 17 has a relatively wide U-shape. The outer sleeve 16 has inturned flanges 18, 19 along the upper edges of its side limbs 20, 21. The flange 18 on one side has a downwardly angled lip 22. In addition, portions 23 of the flanges 18, 19 are pressed out to form shallow slots, for a purpose to be described later.

The filled sleeve 16 forming the insulating sleeve assembly is mounted to the base of the purlin 10 in the manner most clearly shown in FIG. 7. The angled tip 22 of the inturned flange 18 on one limb 20 of the U is hooked over the upturned lip 15 of the purlin bottom flange 14, and the remote side of the sleeve 16 is held in place by retaining clips 24 each having a U-portion 25 which embraces the other limb of the U, including its inturned flange 19, and an upstanding flange 26 which is fixed to the main web 13 of the purlin 10 by a nut and bolt assembly 27, which may include a heat insulating washer.

The purlin 10 is drilled at approximately one metre intervals to take the nut and bolt assembly 27, assuming a purlin approximately 6 to 7 meters long. The outer sleeve 16 and filler 17 contained therein may be produced as sub-units approximately 3 meters long.

It will be observed that the flange 19 of the filled sleeve 16, 17 provides a platform to the side of the purlin 10 opposite to the bottom flange 14 of said purlin, at the same level in relation to the purlin as the flange 18 which has the angled lip 22 hooked over the upturned lip 15 on said purlin bottom flange 14.

During assembly, which is inherently difficult in an elevated roof location, the angled lip 22 is hooked over the upturned lip 15 of the purlin bottom flange 14 temporarily to provide sole support for said sleeve. The latter is then pivoted up against the underside of the purlin bottom flange 14, and fixed in position by means of the retaining clips 24. This is a relatively simple task, since it requires no matching of the holes in the purlin 10 with any particular points on the sleeve 16, as the retaining clips can be positioned substantially anywhere along the sleeve 16 subject to the requirement for reasonably uniform support. A strap 16A (see FIG. 1) fits over the butt joint between adjacent sleeves 16.

Inverted tee-bars 29 (one shown detached in FIG. 1) are then laid between the purlins 10, 10A etc. in spaced parallel relationship, the ends of the crosspieces of the tee-bars being located in the shallow slots 23 in the sleeve flanges 18, 19. Tee-bar retaining clips 30, two of which are shown individually in FIG. 1, fit over the main web of a tee-bar 29 and locate under the end portions of flanges 18, 19 adjacent the pressed out shallow slots 23 to secure the tee-bar in position. It will be noted that the clips 30 provide a substantially flush continuation of the top surfaces of the flanges 18, 19 up to the main web of the located tee-bar 29.

With the arrangement described, a degree of misalignment or deformation between the purlins 10, 10A is tolerable, because a tee-bar 29 can only slip longitudinally down the pitch of the roof as far as permitted by the relatively narrow supporting platform (say 25 mm wide) provided by the flange 19 of the sleeve 16 on the purlin 10A, while at the higher level of the purlin 10 the end of the tee-bar can remain properly supported and located by the flange 18 of the sleeve 16 at a distance of up to about 80 mm from the main web 13 of the purlin. This fairly high degree of tolerance results from the mounting of the purlins 10, 10A with the bottom flanges 14 directed away from the ridge.

Rigid self-supporting panels 31 of insulating, fire-retardant plastics materials are laid in the open rectangular trays formed by the substantially coplanar top surfaces of the flanges 18, 19 and of the crosspieces of the inverted tee-bars 29. The panels 31 are held down in the trays against lift by suitable pressure clips (not shown) mounted on the purlins and/or tee-bars. These panels 31 form a substantially flat ceiling to the building interior.

The above-described arrangement has the advantages of substantially eliminating any cold bride which could permit heat transfer through the purlins 10, 10A from the warm building interior to the cold space above the insulating layer 31, and of providing a cold space of substantial depth below the outer roof covering (not shown) which is fixed in a conventional manner to the top flanges 11 of the purlins. By the use of louvred barge boards at the eaves or other suitable means, this cold space of substantial volume is readily ventilated, thus minimising risk of condensation problems. It is also to be noted that the whole structure is assembled of fire-retardant materials. It is also to be noted that the positioning of the drilled holes for the fixings 27 in the purlin for the clips 24 is not critical, since there is no requirement for positioning of these retaining clips in relation to the length of the insulating sleeve assembly except in so far as a reasonably uniform support is desirable. The outer sleeves 16, the insulating sleeve retaining clips 24 and butt straps 16A provided to cover the butt joints between adjacent insulating sleeve assemblies, may all be formed of cold rolled steel cut to length as necessary, although, as previously mentioned, the outer sleeves 16 may alternatively be produced by a relatively rigid plastics material. The filler in the outer sleeves will, as previously installed, be a plastics insulating material such as polystyrene inserted in the form of cut blocks or polyisocyanurate extruded in situ in the outer sleeve. The outer sleeves 16, retaining clips 24 and butt straps 16A therefor may be painted or plastics coated to improve appearance, e.g. to provide a substantially flat uniformly white ceiling expanse. It is a further advantage of the invention over an over-purlin insulating system that the lower parts of the purlins are not exposed to the building interior. A still further advantage of the roof structure of this invention is that it may be erected entirely from above, dispensing with the requirement for scaffolding within the building.

Another important factor to be understood in relation to the above-described roof structure of this invention is that the insulating sleeve assembly 16, 17 minimises any cold bridge between the building interior and the cold space above the insulating layer 31. Only a minimum of heat conduction can occur through the insulating sleeve retaining clips 24, and this can be substantially eliminated by introducing the abovementioned insulating washer on the bolt fixing said clips to the main web of the purlin. In addition, the cold space above the insulating layer 31 can readily be ventilated, for example by means of louvred barge boards at the gable ends of the building. Problems of condensation are therefore also minimised. It will also be apparent that it is possible to revert to the use of standard length hook members for securing the outer roofing sheets in position, thus reducing the likelihood of deformation occurring within the roof structure.

Figure 2:
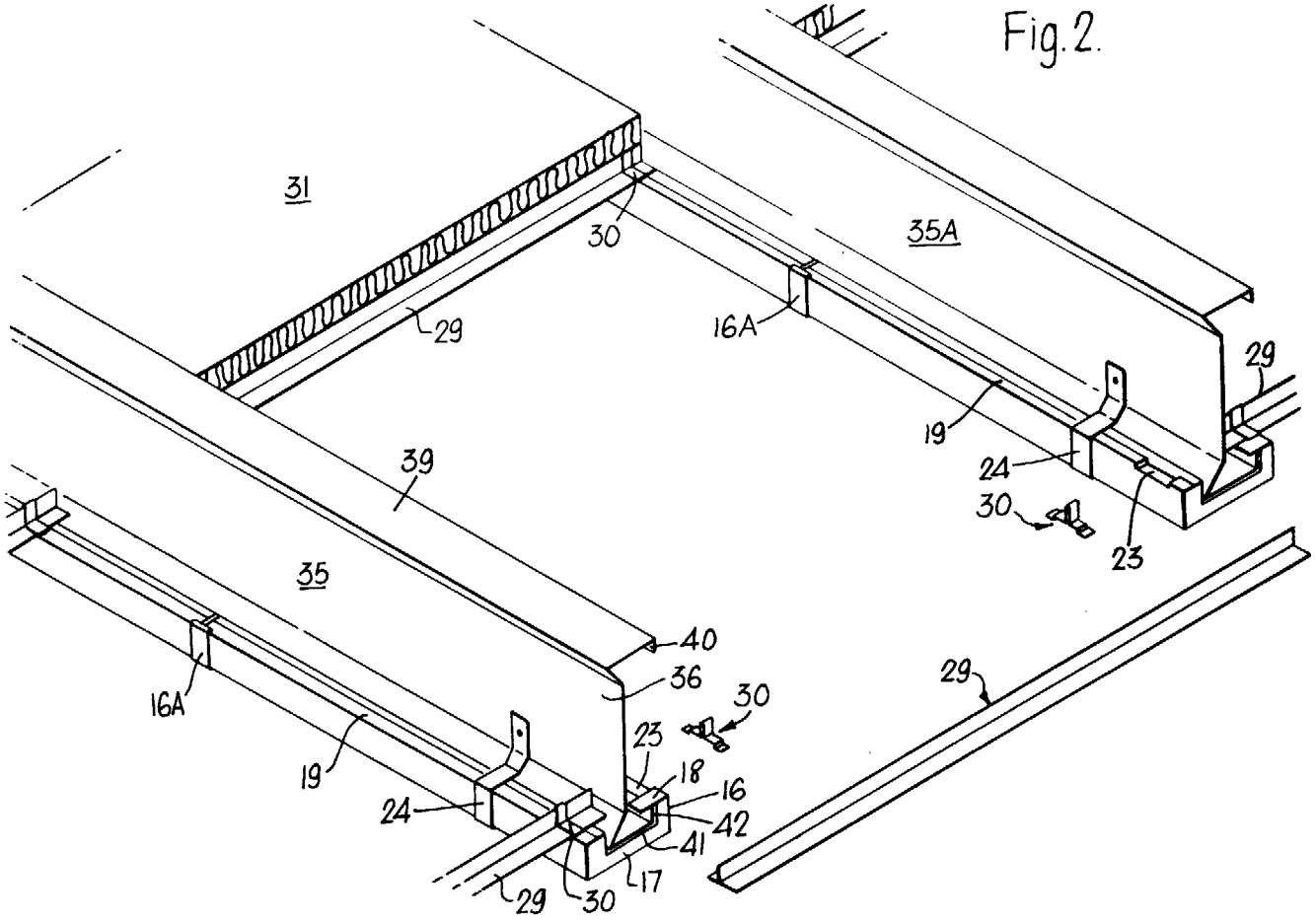
FIG. 2 is a similar view of a modified roof structure based on multi-beam purlins.
Figure 8:
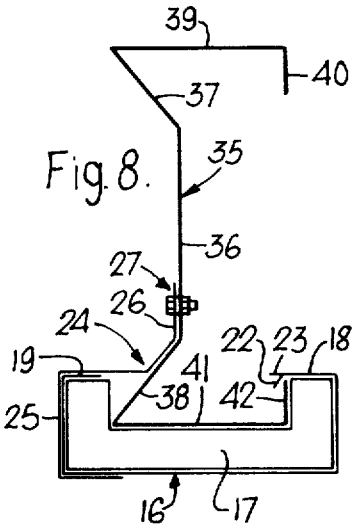
FIG. 8 shows the same sleeve assembly of FIG. 4 assembled to a multibeam purlin.

FIGS. 2, 4 and 8 serve to illustrate a modified arrangement of roof structure which is substantially identical to that previously described except that multibeam purlins 35, 35A are employed instead of Z purlins. In FIG. 2, identical reference numerals to those of FIG. 1 are employed for all components and parts except the purlins, since the modified arrangement has the same basic features and gives rise to the same advantages as the Z-purlin system.

The form of a multibeam purlin appears clearly from FIG. 8. It has a main web 36 with angled portions 37, 38 to provide improved stiffness against twisting and deformation generally, an upper transverse web 39 with depending lip 40, and a lower transverse web 41 with an upstanding lip 42. The insulating sleeve assembly 16, 17 is substantially identical with that previously described, although it can be seen by comparison of FIGS. 7 and 8 that, for the multibeam purlin 35, the limbs of the U-shaped insulating filler 17 can be of equal width instead of the unequal widths shown for the Z-purlin.

It is also to be observed, in connection with FIG. 2, that in a pitched roof the multi-beam purlin 35A will be at a higher level than the multibeam purlin 35.

Figure 3:
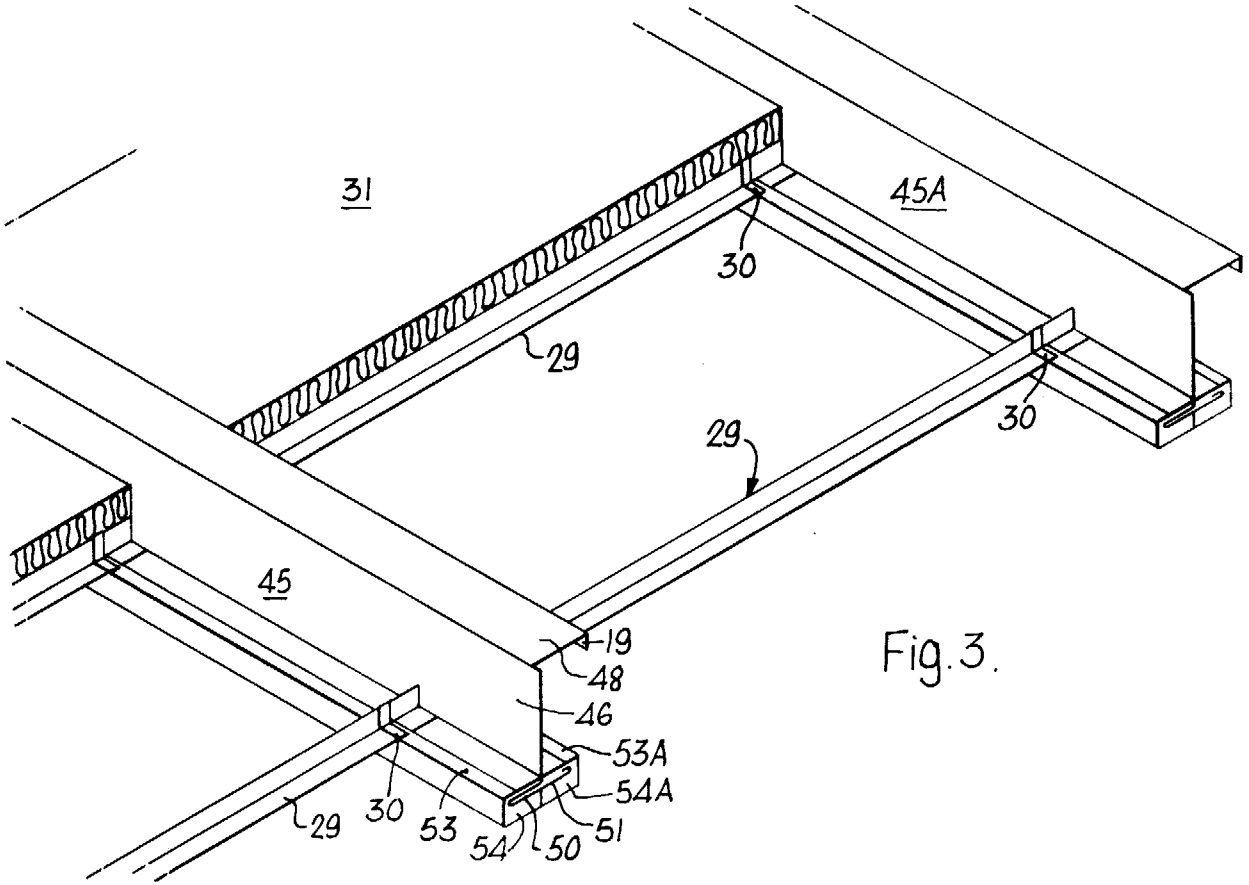
FIG. 3 is a similar view of an alternative arrangement of roof structure incorporating J-purlins.
Figure 6:
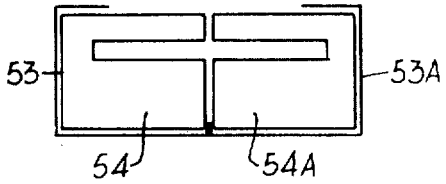
FIG. 6 is a similar view of a longitudinally split insulating sleeve assembly suitable for a J-purlin.
Figure 9:
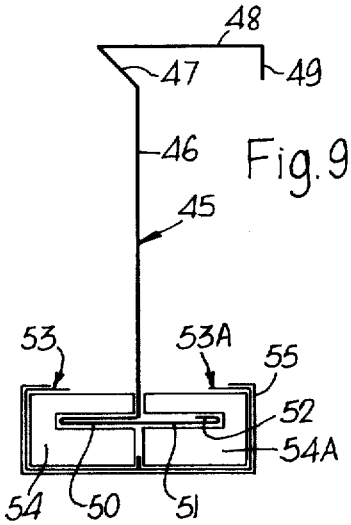
FIG. 9 shows the sleeve assembly of FIG. 6 assembled to a J-purlin.

FIGS. 3, 6 and 9 illustrate an alternative roof structure based on J-purlins 45. In FIG. 3, the J-purlin 45A will, in a pitched roof, be at a higher level than the J-purlin 45, so that in FIGS. 7, 8 and 9 the illustrated purlins are all shown in the same relationship, i.e. pointing up the gable slope to the right in the figures. In FIG. 3, identical reference numerals to FIGS. 1 and 2 are again employed for similar components and parts, and many of the previously stated features and advantages are again applicable. However, a modified insulating sleeve assembly is employed for the J-purlin, as shown in FIG. 6.

Referring first to FIG. 9, the J-purlin 45 has a main web 46, preferably but not essentially incorporating an angled portion 47 connecting to an upper transverse web 48 having a depending lip 49. The angled portion 47 stiffens the fold where the main web 46 connects to the transverse web 48, assuming the purlin to be produced by cold rolling. The J-purlin has base webs 50, 51 respectively projecting to opposite sides of the main web 46. The J-purlin is preferably formed from steel plate by cold rolling, and in accordance with this method of production, the two oppositely directed base webs 50, 51 are formed by folding the steel plate back beneath itself to form one base web, the web 50, of a double thickness of metal (although the two steel layers thereof are not necessarily in close contact). The other base web 51 has a single thickness of metal, but is stiffened with an upstanding lip or, as illustrated, a re-entrant lip 52.

The insulating sleeve assembly for the J-purlin, as shown in FIG. 6, consists of a longitudinally split outer sleeve 53, 53A housing two slotted fillers 54, 54A. The materials used for the insulating sleeve assembly 53, 53A, 54, 54A may be the same as those previously mentioned in connection with the sleeve assembly 16, 17 of the preceding embodiments. The two part sleeve assembly of FIG. 6, one part for each base web 50, 51 of the J-purlin 45, is assembled to the purlin with the aid of retaining bands, one of which is indicated by reference 55 in FIG. 9.

In the J-purlin arrangement, it is to be noted that the insulating sleeve assembly 53, 53A, 54, 54A does not in itself have to provide a tee-bar supporting platform on one side of the main web of the purlin. It will also be noted from FIGS. 3 and 9 that the sleeve retaining clips 24 are no longer required.

Figure 5:
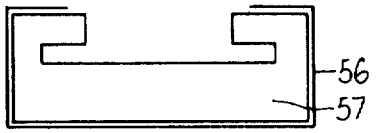
FIG. 5 is a similar view of an insulating sleeve assembly suitable for a J-purlin.

FIG. 5 is provided to show that, in the J-purlin arrangement also, it is possible to employ a unitary insulating sleeve assembly. In this figure, the outer sleeve is referenced 56 and the heat insulating filler 57. A disadvantage which can arise with the sleeve assembly 56, 57 is that it must be slid on to the base of the J-purlin 45 from one end of the latter, and this will often only be possible before the purlin is raised and fixed to the roof stanchions.

Equally, however, it is convenient to mention at this point that, if desired, a longitudinally split insulating sleeve assembly could be employed with a Z-purlin or a multibeam purlin, provided that suitable retaining bands or other suitable retaining means are provided to hold the parts together in assembled condition sheathing the base of the purlin.

Figure 10:
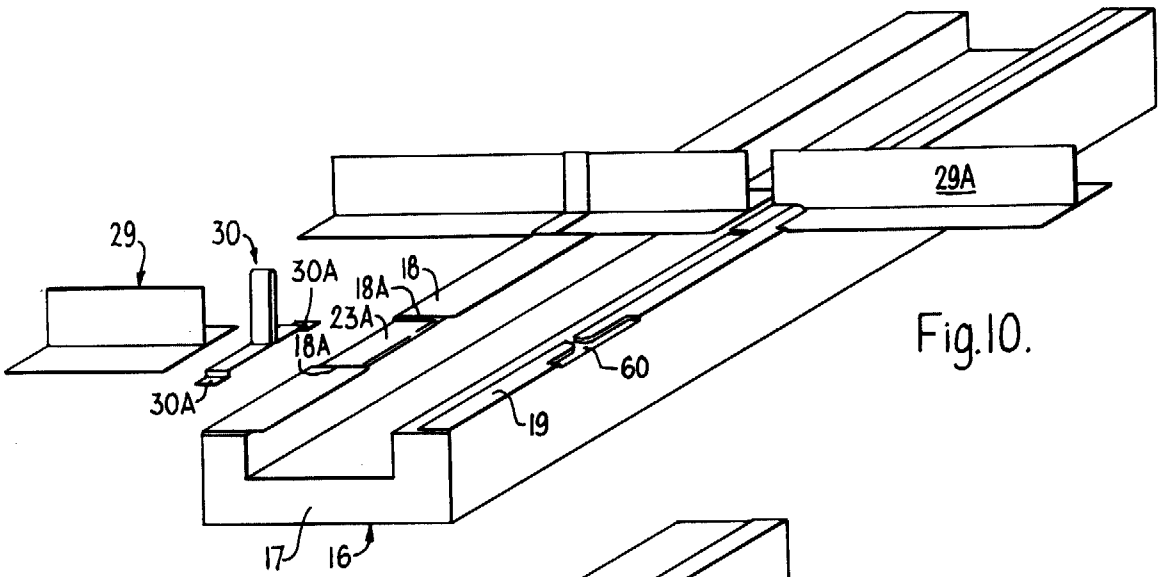
FIG. 10 is a diagrammatic perspective view illustrating location of inverted tee-bars on the sleeve assembly of FIG. 4, the purlin being omitted for clarity.

FIG. 10, employing identical reference numerals to FIGS. 1 and 4, is employed to show in enlargement the manner in which the sleeve assembly 16, 17 serves to locate the ends of the tee-bars 29. The form of a tabbed retaining clip 30 in relation to a broken-off tee-bar 29 is clearly shown on the left-hand side of the figure, while the manner in which a locating recess 23 is formed in the upper flange 18 of the outer sleeve 16 of the sleeve assembly, by partly severing and folding a portion 23A of said flange 18, is also more clearly shown. The lateral tabs 30A on the retaining clip 30 fit under the edge portions 18A of the flange 18 adjacent the recess 23 in order to secure the tee-bar 29 in position.

FIG. 10 also serves to illustrate an alternative locating means for the end of a tee-bar 29, which may be optionally provided in place of the locating recess 23 in the upper flange 19 of the outer sleeve 16 on the opposite side of the purlin from the flange 18 (the purlin, and likewise the angled lip 22 on the flange 18 of the outer sleeve 16, are for clarity omitted in FIG. 10). This comprises a T-slot 60 cut in the flange 19, into which the end of the tee-bar 29 is received directly, the lateral webs of the tee-bar engaging under the flange 19 at the edge portions thereof adjoining the T-slot. This alternative form of locating means in the form of a T-slot 60 is only suitable for the flange 19 of the outer sleeve 16 at the higher level in the roof, i.e. the flange which after erection of the purlin and sleeve assembly in the roof structure is directed away from the roof apex, so that the purlin 29 tends to slide longitudinally down the gable slope into the T-slot.

A located tee-bar is indicated at 29A in FIG. 10.

Figure 11:
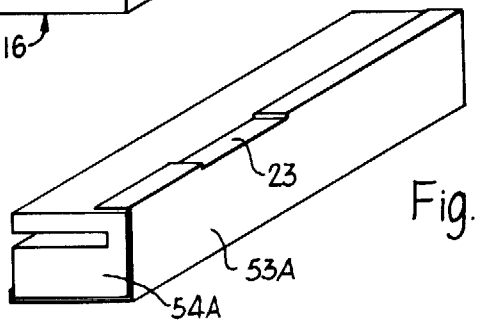
FIG. 11 illustrates, in conjunction with FIG. 10, the analogous location system employed with the sleeve assembly of FIG. 6.

In FIG. 11, the right-hand part 53A, 54A of a longitudinally split sleeve assembly of the kind shown in FIG. 6 is illustrated in enlargement. The purpose is to show the locating recess 23. In a J-purlin arrangement, it is preferred not to employ locating T-slots of the form shown in FIG. 10. However, in all embodiments, various alternative forms of tee-bar locating means may be employed, preferably means carried by the insulating sleeve assembly.

Figure 12:
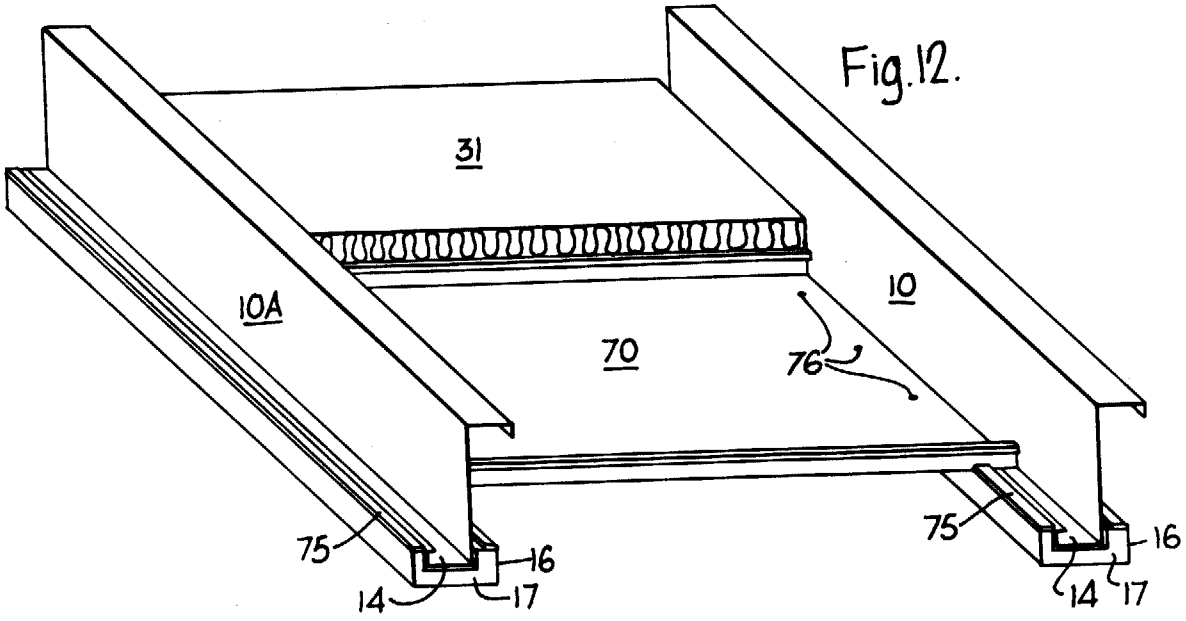
FIG. 12 shows in diagrammatic perspective view a vapour sealed roof structure based on Z-purlins.

A vapour sealed heat insulating roof structure in accordance with the invention is shown in FIG. 12. The preferred arrangement comprises a plurality of spaced parallel roof purlins. Conveniently, these purlins are Z-purlins 10, 10A as previously described with reference to FIG. 7, and the same reference numerals are again employed. Again, as previously described with reference to FIGS. 4 and 7, the base webs 14 of the purlins 10, 10A are sheathed with insulating sleeve assemblies 16, 17.

Figure 13:
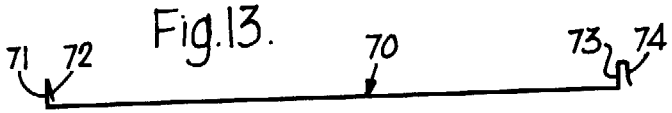
FIG. 13 is an end view of a tray base employed in the arrangement of FIG. 12.

Supported between the insulating sleeve assemblies 16, 17 on the purlins 10, 10A are sheet metal trays 70, one of which is also shown in end view in FIG. 13. Each tray 70 has upstanding walls at its side edges. One such wall 71 has a depending lip 72; the other side wall 73 has a hooked or re-entrant upper edge 74. During assembly of the roof, the hooked edge 74 of the one side wall 73 is filled with a plastic or mastic sealant.

The trays 70 are supported in side-by-side relationship along the lengths of the purlins 10, 10A with the side walls, 71 and 73 respectively, of adjacent trays juxtaposed. The lipped upper edge 72 of the wall 71 interlocks with the hooked upper edge 74 of the wall 73 of the adjacent tray, and is received into the plastic sealant to form a vapour seal therewith.

The sheet metal trays 70 are insulted from the base webs 14 of the purlins 10, 10A by the insulating sleeve assemblies 16, 17. In addition, however, strips 75 of plastic or mastic sealant are laid along the inturned flanges 18, 19 of the outer sleeves 16, on which the end edges of the trays 70 are received when the trays are placed in position. The trays 70 are then rivetted through the sealant to the inturned flanges 18, 19, as indicated at 76, in order to prevent vacuum lift, i.e. lifting of the trays due to air pressure changes in the building space below. The sealant strips 75 ensure a vapour seal between the trays and the purlin assemblies.

Insulation, conveniently in the form of slightly oversized insulating panels 31, is then located in the trays 18. The panels 31 being oversized, they expand to abut one another over the tops of the interlocked side walls 71 and 73 of the trays 70.

In a modification, a pattern of apertures is provided in the sheet metal trays 70, which are then lined, beneath the insulating layer 31, with a plastics sheet, preferably secured to the metal sheet with adhesive, which covers the apertures to maintain a vapour seal. However, the apertures will permit passage of sound through the plastics lining sheet into the insulation, where such is largely absorbed.

It is to be understood that the above-described arrangement is essentially an inter-purlin heat insulating system, like that described with previous reference to any of FIGS. 1 to 3. The outer roof skin, conventionally asbestos sheets, can be secured to the tops of the purlins 10, 10A in the usual manner, i.e. by means of hooked bolts which fix to the upper lateral webs 11 of the purlins. However, various modifications are possible within the scope of the invention. For example, the above-described interlocking side walls for the trays are not essential, since other means can be devised for producing a vapour seal between the juxtaposed side edges of adjacent trays. Other sealing means may be employed between the sheet metal trays and the purlins, and such means may also serve as insulation. However, it remains necessary to sheath the bases of the purlins with insulation in order to eliminate a cold bridge. The essential point of the system, whatever modifications may be introduced, is that a vapour seal is formed between the trays and the purlins, and also between adjacent trays, which substantially prevents the escape of moist warm air from the under space beneath the insulation into the cold upper space above the insulation, thereby minimising or avoiding condensation difficulties.

Figure 14:
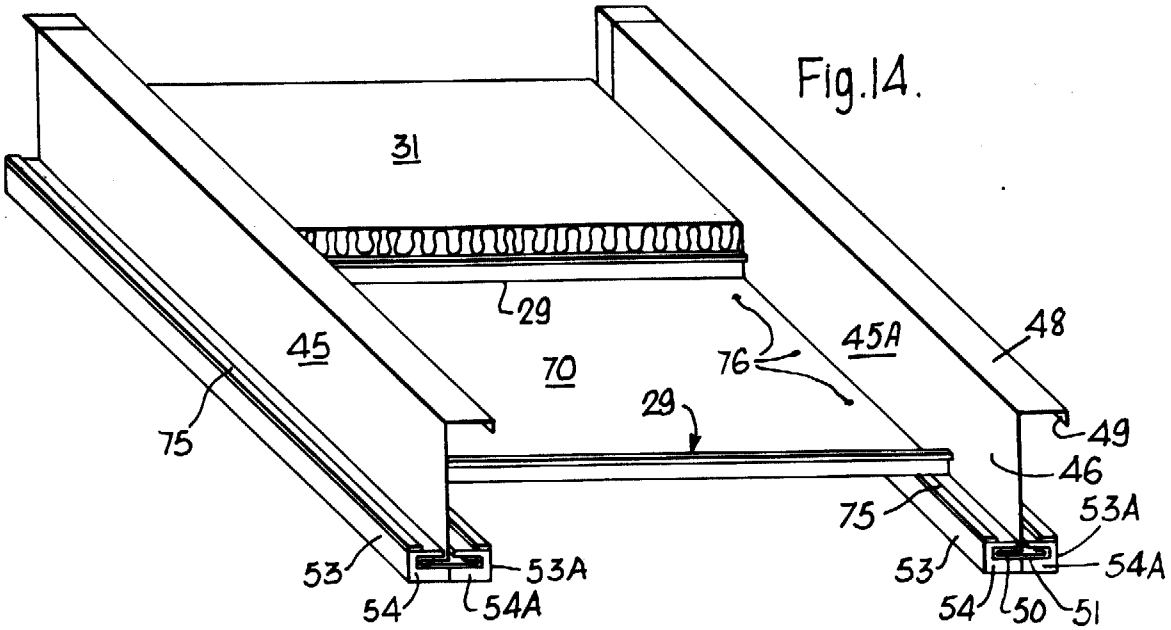
FIG. 14 shows, in like manner to FIG. 12, a vapour sealed roof structure based on J-purlins.

FIG. 14, which will be clear without detailed description, shows a vapour sealed heat insulating roof structure based on J-purlins 45. For idential components and parts, the same reference numerals are employed as in previously described FIGS. 6, 9, 12 and 13.

What is claimed is:

1. A heat insulating roof structure comprising:

a plurality of spaced parallel roof purlins each having a main web, a lateral top web with a downturned edge flange enabling the securing down of outer roofing sheets and, at least on the other side of the main web from the top web, a lateral base web with an upturned edge flange, a heat insulating sleeve assembly sheathing the at least one base web of each purlin, said sleeve assembly comprising a rigid outer sleeve with a heat insulating filler recessed to accommodate the at least one base web of the purlin, said sleeve and insulating filler extending laterally to both sides of the purlin and upwardly to provide a heat insulated supporting surface at the same level on both sides of the main web of the purlin above the upturned edge flange of the at least one base web, and cross members supported on said supporting surfaces to extend in parallel relationship between the purlins and form with said supporting surfaces rectangular frames for supporting a layer of insulating material which forms an inner roofing spaced below the outer roofing.

2. A structure according to claim 1, including cross member locating and retaining means in part integrally formed on the rigid outer sleeves of the sleeve assembly, for locating and retaining the ends of the cross members supported in alignment on the supporting surfaces on opposite sides of a purlin.

3. A structure according to claim 2, wherein the rigid outer sleeve of the sleeve assembly is a cold rolled metal sleeve of U-shape with inturned flanges at the upper edges of its limbs, the locating and retaining means comprising tabs partially severed from said inturned flanges to receive between them the ends of cross members in the form of inverted metal tee-bars, and tabbed bridging clips interengaging with said tabs to hold down the ends of the inverted tee-bars on said supporting surfaces.

4. A structure according to claim 1, wherein said cross members supported between the purlins comprise crosspieces which form rectangularly framed trays each defined by two opposed insulating sleeves and two opposed crosspieces.

5. A structure according to claim 1, wherein said cross members supported between the purlins comprise a plurality of tray bases.

6. A structure according to claim 5, wherein each tray base has opposed side walls transverse to the purlins, said side walls being adapted for interlocking engagement through a sealant to provide a vapour seal at the adjacent side edges of adjacent trays.

7. A structure according to claim 6, including a strip sealant sandwiched between the insulating sleeves and the end edge portions of the tray bases, said end edge portions of the tray bases being rivetted to the insulating sleeves.

8. A structure according to claim 7, wherein the insulating sleeve comprises the assembly of a rigid outer sleeve with a heat insulating filler recessed to accommodate the at least one base web of the purlin.

9. A hear insulating roof structure comprising:

a plurality of spaced Z-type or multibeam-type purlins each having a top web to one side of a main web and a base web with an upstanding edge to the other side of the main web, a heat insulating sleeve assembly sheathing the base web of each purlin, being hooked over the upstanding edge along one side of the main web and being secured by clips along the other side of the main web, said heat insulating sleeve comprising heat insulating material extending to both sides of the main web and upwardly to provide heat insulated supporting surfaces at the same level on both sides of the main web above the level of the upturned edge of the base web, and a heat insulating inner roofing layer supported between the purlins by means which includes metal cross members supported on said supporting surfaces.

10. A structure according to claim 9, wherein the sleeve assembly comprises a metal outer sleeve and a heat insulating filler both extending laterally to both sides of the main web of the purlin and upwardly to form said supporting surfaces.

11. A structure according to claim 10, including cross member locating and retaining means in part integrally formed on the rigid outer sleeves of the sleeve assembly, for locating and retaining the ends of the cross members supported in alignment on the supporting surfaces on opposite sides of a purlin.

12. A structure according to claim 9, wherein, on the side of the purlin main web opposite to the lateral base web, a retaining clip is provided to secure the insulating sleeve to the purlin, and wherein the insulating sleeve has a top flange with a depending lip adapted, during assembly of the sleeve to the base web of the purlin; to enable said sleeve to be suspended from said base web.

13. A structure according to claim 11, wherein the retaining means comprises portions cut away in a top flange of the outer sleeve to provide a recessed seating for the ends of the tee-bars, and tabbed bridging clips for fitting over the ends of the tee-bars with their tabs engaging under the top flange of the outer sleeve adjacent the cut away portions.

14. A heat insulating roofing structure comprising:

a plurality of spaced parallel J-type purlins each having a lateral top web to one side of a main web and base webs to opposite sides of the main web, a heat insulating sleeve assembly sheathing said base webs, said sleeve assembly comprising a fire-retardant rigid outer sleeve and a less rigid infilling of heat insulating material recessed to accommodate the purlin base webs and provide heat insulating filler both above and below said base webs, said sleeve assembly forming a heat insulating supporting surface at the same level on both sides of the base webs above the level of the latter, and metal cross members supported on said supporting surfaces to extend between the purlins, insulated from the base webs of the purlin by said heat insulating filler.

15. A structure according to claim 14, including cross member locating and retaining means in part integrally formed on the rigid outer sleeves of the sleeve assembly, for locating and retaining the ends of the cross members supported in alignment on the supporting surfaces on opposite sides of a purlin.

16. A structure according to claim 14, wherein the insulating sleeve is formed in two longitudinally split parts, one for each base web of the purlin, and retaining bands are provided to hold said two sleeve parts together in assembled condition sheathing the two webs.

* * * * *